US009382725B2

(12) United States Patent
Kaplan

(10) Patent No.: US 9,382,725 B2
(45) Date of Patent: Jul. 5, 2016

(54) TOWELOCK

(71) Applicant: Edward Kaplan, Las Vegas, NV (US)

(72) Inventor: Edward Kaplan, Las Vegas, NV (US)

( * ) Notice: Subject to any disclaimer, the term of this patent is extended or adjusted under 35 U.S.C. 154(b) by 0 days.

(21) Appl. No.: 14/492,023

(22) Filed: Sep. 21, 2014

(65) Prior Publication Data

US 2015/0041612 A1 Feb. 12, 2015

Related U.S. Application Data

(60) Provisional application No. 62/021,091, filed on Jul. 4, 2014.

(51) Int. Cl.
*E04H 15/62* (2006.01)
*A47G 9/06* (2006.01)
*E04H 15/64* (2006.01)

(52) U.S. Cl.
CPC ..... *E04H 15/62* (2013.01); *A47G 9/062* (2013.01); *E04H 15/64* (2013.01)

(58) Field of Classification Search
CPC ..... E04H 15/32; E04H 15/62; E04H 15/64; A47G 9/062; Y10T 24/44427; Y10T 24/4453; Y10T 24/44547
USPC ..... 248/500, 506, 508, 509, 156, 530, 545, 248/316.7, 231.81, 230.7, 228.7; 5/417; 135/118; D8/388, 391, 393–395; D21/796, 840; D26/67
See application file for complete search history.

(56) References Cited

U.S. PATENT DOCUMENTS 2,647,718 A 8/1953 Disera
2,665,866 A * 1/1954 Goldinger ..... 43/21.2
2,840,092 A * 6/1958 Hill ..... E04H 15/003 135/118
2,939,468 A * 6/1960 Boyce ..... 248/508
3,241,202 A 3/1966 Knauft
D275,555 S * 9/1984 Giggey ..... D8/388
4,914,767 A * 4/1990 Balicki et al. ..... 5/419
5,150,485 A 9/1992 Maguire
5,176,354 A 1/1993 Feigenbaum
5,245,715 A * 9/1993 Dinkins ..... E04H 15/62 135/118
5,390,890 A 2/1995 Ferguson
5,474,275 A * 12/1995 Robertson et al. ..... 248/508
5,524,309 A 6/1996 La Barbera
5,579,798 A * 12/1996 Pruitt ..... E04H 15/62 135/118
5,713,383 A * 2/1998 Ramirez et al. ..... 135/118
5,823,504 A * 10/1998 Kuwajima ..... H04M 1/12 248/188.8
D476,556 S * 7/2003 Martin et al. ..... D8/395
6,938,384 B1 9/2005 Hodge
7,159,256 B1 * 1/2007 Licari ..... 5/417
7,921,815 B2 * 4/2011 Moran ..... A01K 1/04 119/786
8,302,922 B1 * 11/2012 Robinson ..... A47G 25/08 211/107
8,671,847 B2 * 3/2014 Lymberis ..... A01M 31/02 108/42
8,997,278 B1 * 4/2015 Vanvliet ..... 5/417
2004/0124331 A1 * 7/2004 Kornacki ..... 248/500
2013/0048804 A1 * 2/2013 Furuta et al. ..... 248/168
2014/0036487 A1 * 2/2014 Adams ..... 362/184
2015/0041612 A1 * 2/2015 Kaplan ..... E04H 15/62 248/508

* cited by examiner

*Primary Examiner* — Jonathan Liu
*Assistant Examiner* — Guang H Guan

(57) ABSTRACT

This invention provides for an apparatus for securing corners or edges of a piece of fabric that is used for covering ground surfaces. The apparatus includes a clip for gripping the piece of fabric and a stake with a spike for anchoring the apparatus into the ground surfaces. When a user presses rear ends of the clip, the stake and the spike would be released such that the apparatus could be anchored to the ground surfaces.

7 Claims, 4 Drawing Sheets

TOWELOCK

BACKGROUND OF THE INVENTION

1. Field of the Invention

This invention relates to the field of creating a new and improved apparatus for securing a piece of fabric or material covering porous ground surfaces.

2. Background Art

Lying on a towel or blanket on the ground, lawn or sandy beach has been common practice for people. The problem has always been that the movement of the towel or blanket on porous ground surfaces caused by the wind, general movement of the person lying on the towel or blanket, or by people walking on the article. It is not uncommon to see people using paperweight like objectives on all four corners or edges of the towel or blanket to keep it in original position.

Manufacturers have produced and marketed beach towel holding and anchoring devices. Some have used spikes to secure the corners or edges of the towel or blanket, but the devices damage the towel or blanket by punching holes in it or fraying. Others made the devices with clamps and spikes to secure the towel or blanket, but the spikes are not small in size and are not easy to carry inside a handbag or carrier and are piercing. None of these devices have been very satisfactory to enable a cover, such as a towel or blanket to be held in an upright relation along its side edge portions to thus restrict the blowing-in of sand, upon the surface of the cover.

A portable holding device to secure a piece of fabric or material on porous ground surfaces is capable of other embodiments and being practiced and carried out in various ways. Those skilled in the art will appreciate that the conception, upon which this disclosure is based, may readily be utilized as a basis for the designing of other structures, methods and systems for carrying out the several purposes of the present fabric holding apparatus.

SUMMARY OF THE INVENTION

It is the object of this invention to provide a new and improved holding apparatus, which may be easily and efficiently to maintain a piece of fabric or material in its original position with flexibility and resiliency to accommodate variances in the depth of the porous ground surfaces and a reasonable movement of the fabric or material. The apparatus in this invention is comprised two major portions, which would include a stake portion and a clip portion. The clip would be affixed to the top of the stake portion of this invention. The clip would normally be in a closed position, but could be opened by pressing the rear handles of the clip portion together, placing an edge of the desired fabric or material within the clip, and then releasing the handles of the clip to effectively secure the fabric or material to the apparatus. The stake portion is collapsible and extendable via a spike, which allows the stake to be pushed down into the porous ground surfaces. The elongated anchor is relatively stiff and when locked in place, which provides for the resilience necessary to hold the clamp in place in relation to where is it anchored.

Additionally, another object of this invention is the changeable shapes of the clip, a means to display advertising and/or a symbol of the user's personal interests. This additional functionality is accomplished by replacing the clip with a different shape, which is discussed in the specification.

DETAILED DESCRIPTION OF THE INVENTION

Figure 1:
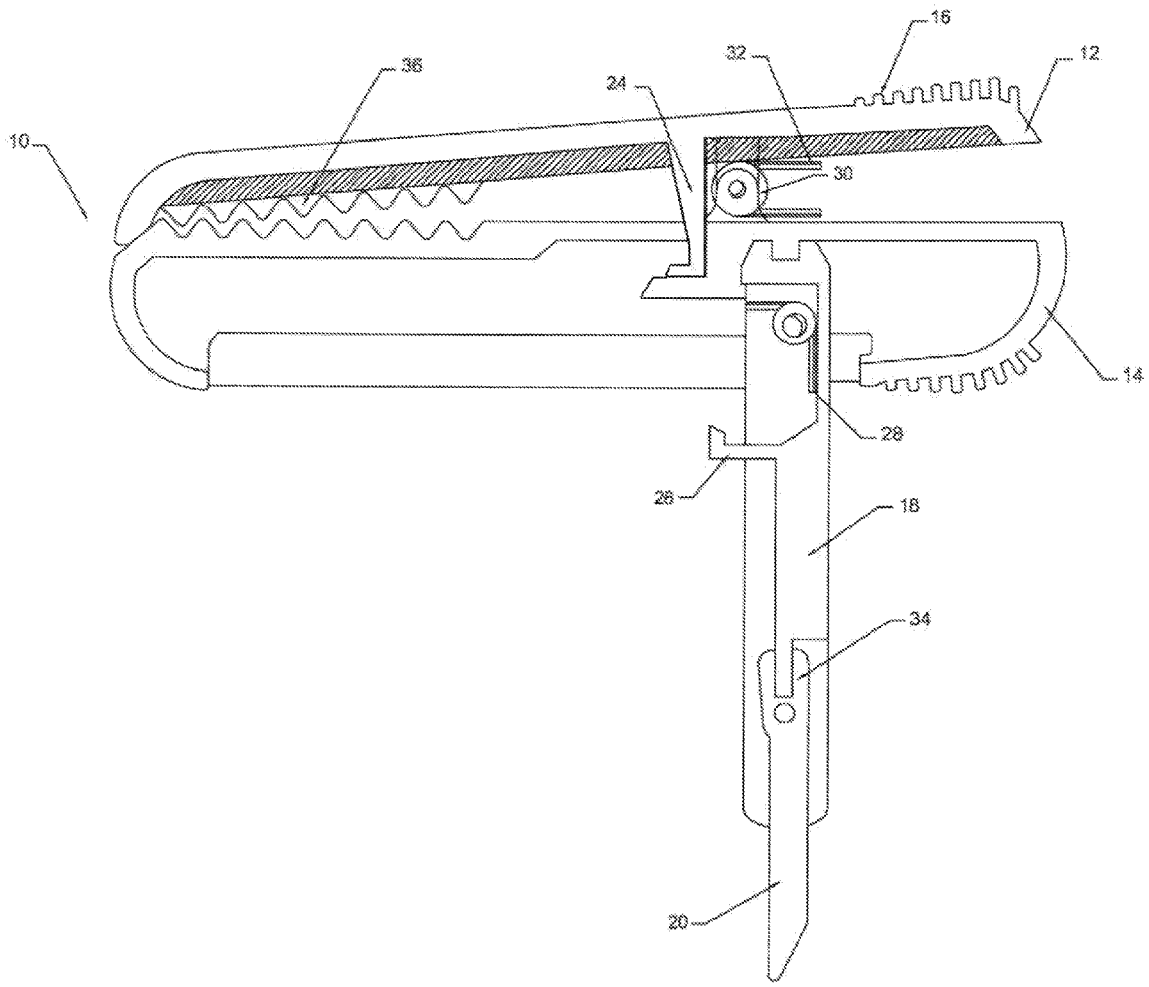
FIG. 1 shows a side elevation view of the apparatus with the stake and the spike in vertical axis position.
Figure 2:
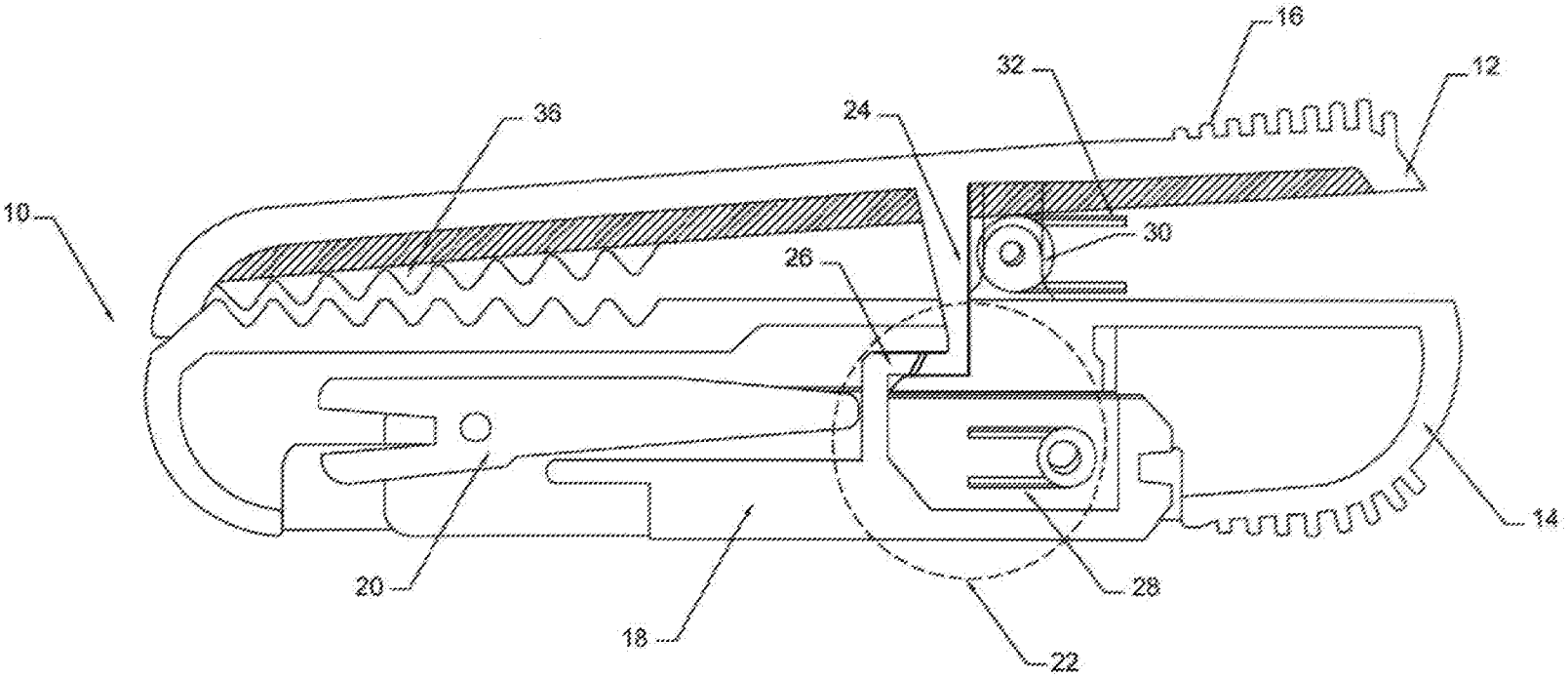
FIG. 2 shows a side elevation view of the apparatus with the stake and the spike in a closed position folded into the embedded space within the bottom of the base.

Referring to FIG. 1 and FIG. 2 which show the side view of this invention, the apparatus comprises a clip 10, a stake 18, a spike 20, a stake locking mechanism 22, a conjoined fulcrum 30, and a spike locking mechanism 34. The clip 10 may differ in size, shape, color or other characteristics of appearance.

Referring to FIG. 1 and FIG. 2, the clip 10 a top base 12 and a bottom base 14, wherein each of the top base 12 and the bottom base 14 includes two ends, i.e., a front end and a back end. The back ends of the top base 12 and the bottom base 14 contain grooved grip 16 to provide for easy opening and closing of the top base 12 and the bottom base 14 without slippage. The front ends of the top base 12 and the bottom base 14 contain grooves and teeth 36 to provide for maximum gripping of an article. When a user places pressure simultaneously on the back ends of the top base 12 and the bottom base 14 together, the clip 10 would open such that an edge or a side of a fabric or material may be placed between the front ends of the top base 12 and the bottom base 14. This action will in turn release the stake 18 and the spike 20 via a torsion spring 28 to a 90° angle and lock the stake 18 into place. Releasing pressure of the back ends of the top base 12 and the bottom base 14 would allow the clip 10 to tightly grip the edge or the side of the fabric or material with the grooves and the teeth 36 due to the pressure of the torsion spring 32. The edge or the side of the fabric or material would only be released when the user squeezes the top base 12 and the bottom base 14 together, and the fabric or material can be removed without any damage to the article that was attached.

Referring to FIG. 2, the stake locking mechanism 22 comprises a stake release lever 24, and a stake lock 26, and a torsion spring 28 connected to the pivotal fulcrum by a pin to join the bottom base 14 and the stake 18. The stake release lever 24 extends downwardly from a lower surface of the top base 12 beyond the conjoined fulcrum 30 and into an empty space formed within the bottom base 14. Moreover, as seen in FIG. 1 and FIG. 2, the stake release lever 24 includes a lever portion extended from the top base 12, wherein the lever portion includes a top end attached to the top base 12 and a bottom and narrower than the top end. The stake release lever 24 further includes a pushing portion extending laterally from the bottom end of the lever portion of the stake release lever 24. As seen in FIG. 1 and FIG. 2, the bottom base 14 includes a stake locking portion positioned below the stake release lever 24 and extending into the empty space formed within the bottom base 14.

Referring to FIG. 1 and FIG. 2, the stake 18 includes an elongate main stake portion having two ends, i.e., an upper end and a bottom end. The upper end of the stake 18 is pivotally connected to the bottom base 14 of the clip 10 with a pivot joint. The bottom end of the stake 18 is pivotally connected to the upper end of the spike 20. When the stake 18 and the spike 20 are extended and lowered to a 90° angle to the clip 10, the stake 18 and the spike 20 can be inserted into porous surfaces to anchor each corner edge of the fabric or material. The elongated main stake portion further comprises a middle portion between the upper end and the bottom end, wherein the stake lock 26 extends from the middle portion of the elongate main stake portion of the stake 18. The stake lock 26 includes a projecting portion extending from the middle portion of the elongate main stake portion of the stake 18. The stake lock 26 further includes a locking portion extending from the projecting portion and having an inclined end surface. When the back ends of the top base 12 and the bottom base 14 are squeezed together, the stake release leaver 24 would laterally push the locking portion of the stake lock 26 to release the stake 18 and the spike 20 into a 90° vertical access position such that the stake 18 and the spike 20 may be used to anchor the apparatus into porous surfaces. When not in use, the stake 18 and the spike 20 may be folded and retracted into the bottom base 14 with the stake lock 26 directly engaging the stake locking portion formed within the bottom base 14 such that the stake 18 and the spike 20 are securely locked in place within the bottom base 14.

Referring to FIG. 1, the spike 20 includes an upper end and a bottom end, wherein the upper end of the spike 20 is pivotally connected to the bottom end of the stake 18. The bottom end of the spike 20 is tapered longitudinally to a point at a free end to insert the spike 20 into porous surfaces. The spike 20 would be extractable and extendable to prolong the stake 18 providing a vertical tolerance for variances in the depth of porous surfaces into which the stake 18 in the spike 20 can be driven.

Figure 4:
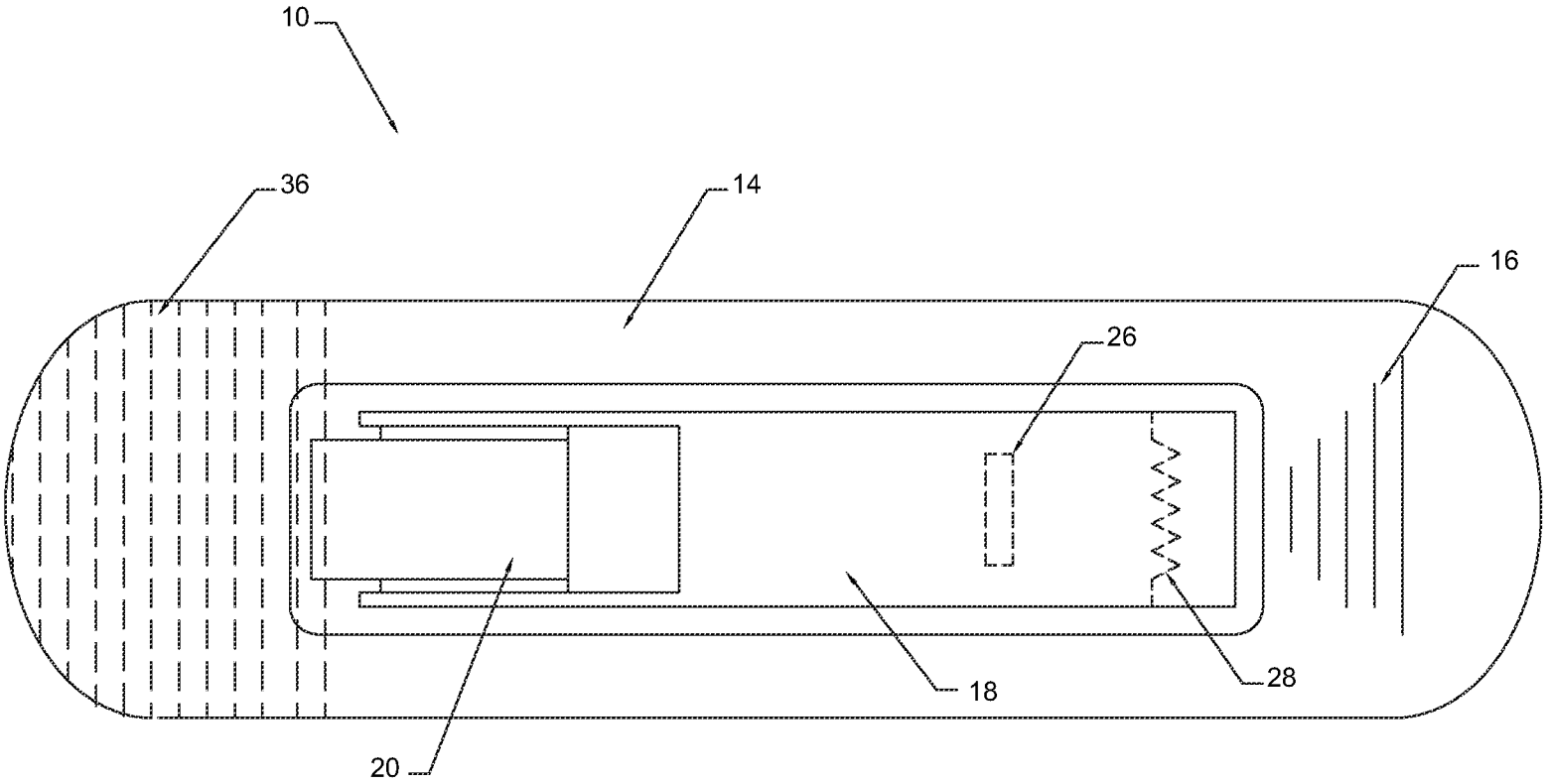
FIG. 4 shows the apparatus with a clear bottom view of the bottom base.

Referring to FIG. 2 and FIG. 4, the stake 18 and the spike 20 are collapsible under the bottom base 14, thereby providing a means of flexibility to store safely the apparatus in a pouch inside a handbag or a carrier without snagging or piercing any items where it is stored.

Figure 3:
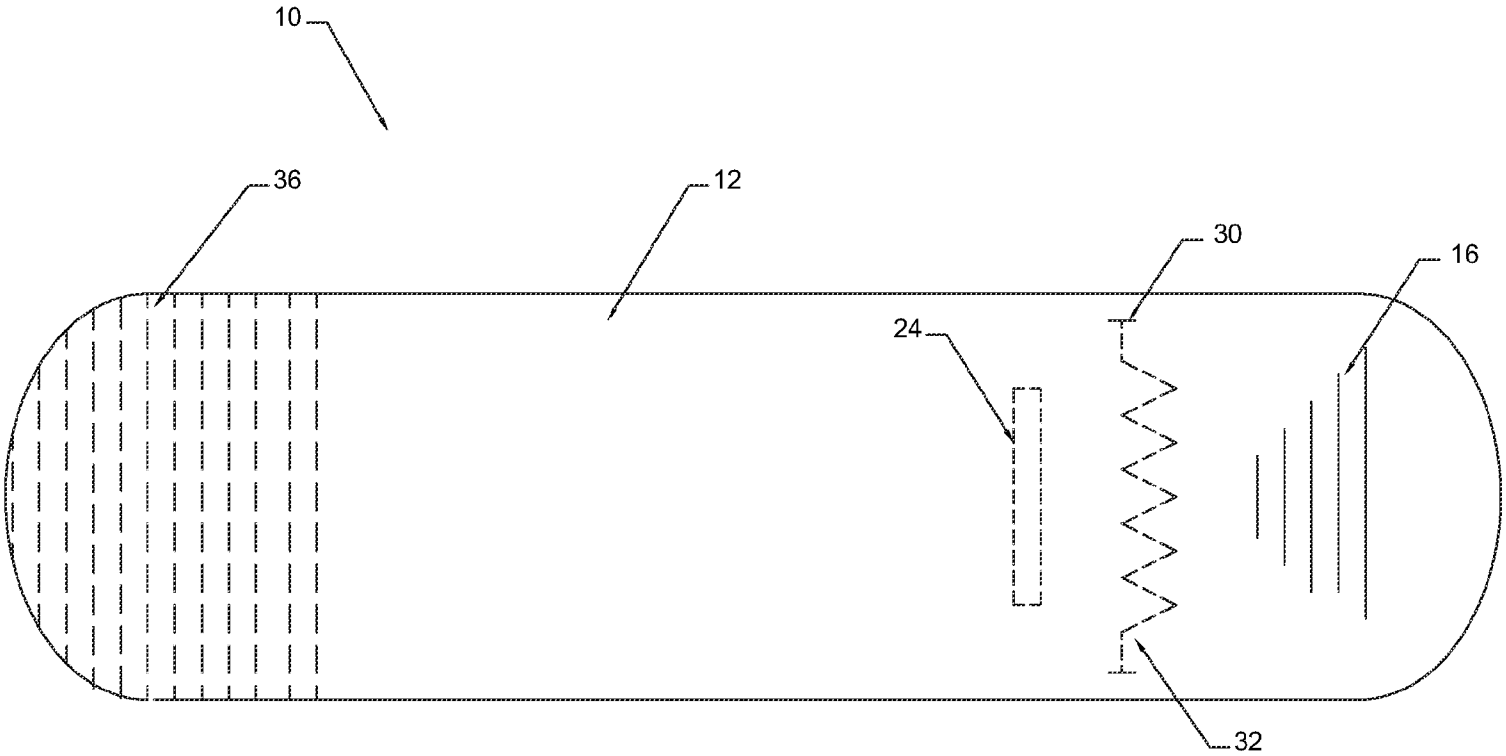
FIG. 3 shows the apparatus with a clear top view of the top base.

Referring to FIG. 2 which shows a side elevation view of the clip 10, the top base 12 is joined to the bottom base 14 by a resilient conjoined fulcrum 30. As shown in FIG. 2 and FIG. 3, the conjoined fulcrum 30 contains a torsion spring 32, which is connected to the pivotal fulcrum by a pin to join the top base 12 and the bottom base 14.

Referring to FIG. 1, the spike 20 is locked with the stake 18 using a locking mechanism 34 for prolonging the stake 18. By this arrangement, the stake 18 and the spike 20 would be secured in a locked vertical axis position to anchor the clip 10 apparatus into porous surfaces.

What I claim as my invention is:

1. An apparatus for securing a piece of fabric in position on ground, the apparatus comprising:

(a) a clipping portion for gripping the piece of fabric, the clipping portion including:

a top base having a front end and a rear end, wherein the front end of the top base includes a plurality of grooves and a plurality of teeth for gripping the piece of fabric;

a bottom base having a front end and a rear end, wherein the front end of the bottom base includes a plurality of grooves and a plurality of teeth for gripping the piece of fabric;

a base connecting joint pivotally attaching the top base to the bottom base;

wherein the top base further includes a stake release lever extending downwardly from a lower surface of the top base beyond the base connecting joint and into an empty space formed within the bottom base, the stake release lever includes a lever portion and a pushing portion, the lever portion includes a top end and a bottom end, and the pushing portion extends laterally from the bottom end of the lever portion; and wherein the bottom base further includes a stake locking portion positioned below the stake release lever and extending into the empty space formed within the bottom base; and (b) a stake for securely anchoring the apparatus on ground, the stake including:

an elongate main stake portion having a first end, a middle portion, and a second end, wherein the elongate main stake portion is pivotally connected to the bottom base of the clipping portion at the first end of the elongate main stake portion by a pivot joint;

an extension spike connected to the elongate main stake portion at the second end of the elongate main stake portion, wherein the extension spike includes a tapered free end distal from the second end of the elongate main stake portion, and the extension spike is configured to prolong the elongate main stake portion when in use;

wherein a stake lock extends from the middle portion of the elongate main stake portion, the stake lock includes a locking portion and a projecting portion connected to the middle portion of the elongate main stake portion;

wherein when the stake is folded and retracted into the empty space of the bottom base, the locking portion of the stake lock is configured to directly engage the stake locking portion of the bottom base such that the stake is securely locked within the bottom base; and wherein when the rear end of the top base and the rear end of the bottom base are squeezed, the pushing portion of the stake release lever is configured to laterally push the locking portion of the stake lock, thereby releasing the locking portion of the stake lock from the stake locking portion of the bottom base such that the stake is released from the empty space of the bottom base for use.

2. The apparatus of claim 1, wherein the base connecting joint includes a torsion spring and a pin, the pin is coupled to the top base and the bottom base, and the torsion spring is configured to urge the clipping portion to a closing state.

3. The apparatus of claim 1, wherein the pivot joint includes a torsion spring and a pin, and the pin is coupled to the bottom base and the stake.

4. The apparatus of claim 1, wherein the rear end of the top base includes a plurality of grooved grips on an upper surface of the top base to allow opening and closing of the top base without slippage.

5. The apparatus of claim 1, wherein the rear end of the bottom base includes a plurality of grooved grips on a lower surface of the bottom base to allow opening and closing of the bottom base without slippage.

6. The apparatus of claim 1, wherein the bottom end of the lever portion of the stake release lever is narrower than the top end of the lever portion of the stake release lever.

7. The apparatus of claim 1, wherein the locking portion of the stake lock includes an inclined end surface.

* * * * *